United States Patent [19]

Irwin

[11] 4,071,811

[45] Jan. 31, 1978

[54] MODEL HELICOPTER THROTTLE GOVERNOR/COLLECTIVE PITCH CONTROL APPARATUS

[76] Inventor: Arlyle Floyd Irwin, 1312 W. Hill St., Champaign, Ill. 61820

[21] Appl. No.: 662,694

[22] Filed: Mar. 1, 1976

[51] Int. Cl.[2] ..... H04Q 7/02; B61B 13/08

[52] U.S. Cl. ..... 318/16; 318/584; 244/189; 244/180

[58] Field of Search ..... 244/7 A, 8, 10, 17.11, 244/181, 182, 189, 190, 17.13; 318/584, 580, 581

[56] References Cited

U.S. PATENT DOCUMENTS

| | | | |
|---|---|---|---|
| 3,096,046 | 7/1963 | Kendall | 244/17.13 |
| 3,622,973 | 11/1971 | Domann | 340/52 R |

*Primary Examiner*—Robert K. Schaefer
*Assistant Examiner*—Leonard Pojunas
*Attorney, Agent, or Firm*—Merriam, Marshall & Bicknell

[57] ABSTRACT

A throttle governor/collective pitch control apparatus for radio controlled model helicopters for proportionally controlling either the model helicopter rotor speed or the rotor collective pitch, including sensing and timing means determining the rotor speed and any changes thereof, comparison means for comparing a subsequently sensed rotor speed with a first sensed rotor speed and developing an error signal, and control means responsive to the error signal to provide a control signal proportional to any changes in the rotor speed. In the throttle governor mode any variations in rotor speed result in a proportional control signal to vary the model helicopter throttle so as to maintain constant rotor speed. In the auto-collective mode changes in rotor speed result in a proportional control signal coupled to the collective pitch servo for proportionally varying the model helicopter collective pitch.

8 Claims, 5 Drawing Figures

MODEL HELICOPTER THROTTLE GOVERNOR/COLLECTIVE PITCH CONTROL APPARATUS

This invention relates to model helicopters and in particular to radio control apparatus for flying such helicopters.

BACKGROUND

Reference may be made to the following U.S. patents of interest: U.S. Pat. Nos. 2,517,150; 2,613,751; 2,689,010; 3,096,046; 3,228,629; 3,622,973; 3,659,236; 3,857,194; and German Pat. No. 1,965,871.

In full size as well as radio controlled model helicopters, vertical movements of the craft can be provided by either varying the main rotor rotational speed or by varying the main rotor collective pitch (the average incidence angle of all blades on the rotor). Horizontal, forward or reverse movements of a helicopter can be provided by variations in the main rotor pitch during rotation — known as cyclic pitch. Undesired rotation of the helicopter fuselage can be provided by various techniques, one of which is to vary the collective pitch or the rotational speed of a tail rotor rotating in a plane orthogonal to the main rotor. The present invention is only concerned with controlling the vertical movement of a radio controlled model helicopter.

The pilot of a radio controlled model helicopter either has separate throttle and collective pitch controls on a radio transmitter unit, or more often, the two functions are coupled and controlled from a single throttle-collective control on the radio transmitter unit. The respective control signals are transmitted to and received by a receiver unit in the model helicopter. These control signals are then decoded for driving a respective throttle servo coupled to an engine for rotating the helicopter main rotor; or, for driving a collective pitch servo for varying the collective pitch in a known manner. In the case of a coupled throttle/collective system both throttle and collective operate from a single servo. Flying model helicopters is thus a delicate procedure requiring some degree of coordination between variations in the throttle and the collective pitch controls. If, for instance, the throttle were increased, the rotor speed would tend to increase, but at a high initial collective pitch the load on the rotor might become intolerable and the engine would start to stall. In the coupled system where both functions are on a single control, it becomes difficult to obtain correct mechanical relationship such that the proper amount of power is present for any given collective pitch setting.

In full size helicopters, rotor speed and rotor pitch governor systems have been utilized to aid in the coordination of the throttle and collective pitch functions. For instance, in a throttle governor system for full size helicopters, the throttle is adjusted in accordance with the speed of the main rotor so as to maintain a constant rotor speed, and the lift of the rotor is then controlled by varying the rotor pitch. In addition, in full size helicopters there has also been provided a collective pitch governor system wherein the pitch of the rotor is adjusted in accordance with the speed of the rotor to maintain substantially constant rotor speed, and the lift of the rotor is controlled by varying the throttle. The apparatus involved in such full size systems are obviously quite large and bulky and are not readily adaptable for use with small sized radio controlled model helicopter apparatus.

Attempts have been made in the prior art to provide some automatic correlation in the throttle and collective pitch controls for model helicopters. As an example, a mechanical coupling has been provided between the throttle and collective pitch controls, however, under some flight situations this interconnection becomes a hindrance rather than an aid. It is therefore desired to provide a workable system wherein a model helicopter pilot could fly the helicopter by varying either the throttle or the collective pitch control and the other respective control would be automatically controlled. This would make the automatically controlled function related to, but indirectly coupled to the manually controlled function.

SUMMARY OF THE INVENTION

Accordingly, the present invention provides throttle governor apparatus for radio controlled model helicopters wherein the helicopter may be flown in a throttle governor mode by varying the collective pitch and the rotor rotational speed is kept constant by automatically varying the throttle to attain constant rotor RPM. In another embodiment of the invention, there is provided auto-collective pitch apparatus wherein the helicopter may be flown in an auto-collective mode by varying the throttle and the collective pitch is automatically varied in response to the rotor RPM changes produced by the operator's variation of the throttle control. In both embodiments, sensing and timing means are provided for sensing the rotor speed and determining through timing logic circuits incorporating a timing reference whether the rotor speed is steady, increasing or decreasing. Error means compare the timing reference and the sensed rotor speed to develop an error signal, and control means respond to the error signal to provide a control signal proportional to any RPM changes.

In the throttle governor mode, the control signal is coupled to the throttle servo to vary the throttle and maintain constant rotor speed. Alternatively, in the autocollective mode, the developed control signal is coupled to the collective pitch servo for automatically varying the collective pitch in response to rotor RPM.

DETAILED DESCRIPTION

Figure 1:
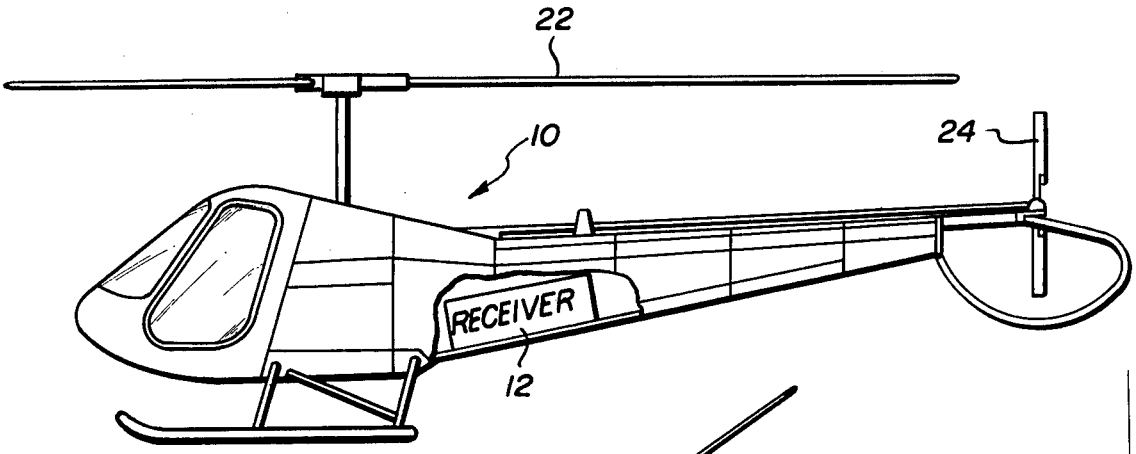
FIG. 1 is a schematic illustration of a model helicopter containing a receiver and being controlled by a signal transmitter in a typical model helicopter radio control system.
Figure 1:
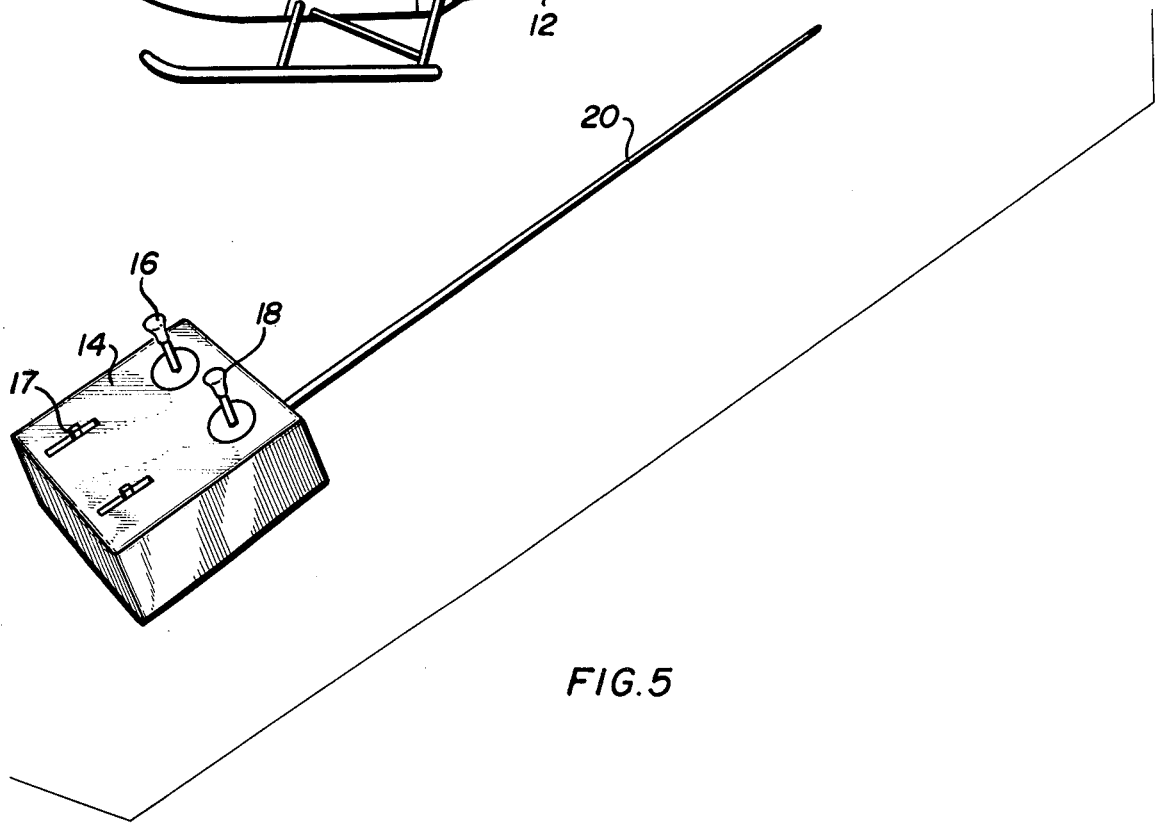

Referring now to FIG. 1, there is schematically illustrated a model helicopter 10 containing a signal receiver 12 for receiving signals from a signal transmitter 14 during control of the helicopter. The control sticks 16 and 18 are manipulated by the model helicopter pilot so as to develop signals transmitted from the antenna 20 and received and amplified by receiver 12 in the model helicopter to control the rotational speed, collective pitch and cyclic pitch of the main rotor 22 and to vary the rotational speed and/or collective pitch of the tail rotor 24. Hereinafter there is described apparatus for controlling the vertical movement of the radio controlled model helicopter 10 by either varying the rotational speed or the collective pitch of the main rotor 22. Auxiliary channel control 17 will provide transmitter clock pulses for the apparatus of the present invention, which pulses are between 1ms and 2ms pulse widths as set by the control 17.

Figure 2:
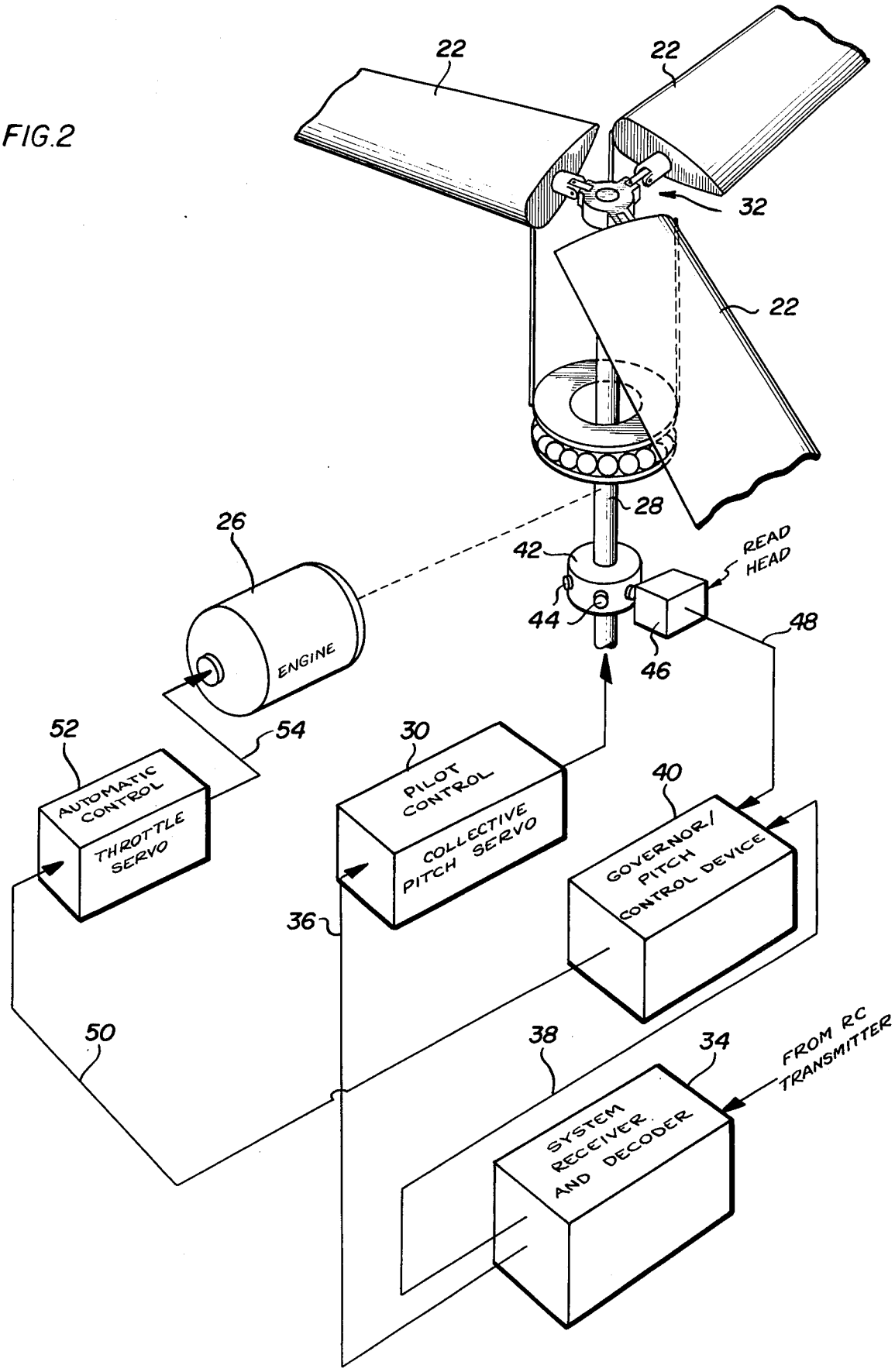
FIG. 2 illustrates one embodiment of the present invention in the throttle governor mode with the model helicopter pilot controlling collective pitch and timing and control means being provided to automatically vary the throttle in response to the rotor RPM.

FIG. 2 illustrates a three-bladed main rotor 22 which is rotated by an engine 26 through well known means (not shown) such as drive belts, etc. The collective pitch of the main rotor blades 22 is varied in response to a collective pitch servo 30 in a standard manner, one of which is illustrated in FIG. 2. Each of the rotor blades 22 is connected to the rotor shaft 28 through a coupler 32 such that the collective pitch may be changed by vertical movements in the shaft 28 as illustrated. It is to be understood that the drive coupling between the engine 26 and the rotor shaft 28 so as to vary the shaft rotational speed in response to the engine 26; and the coupling mechanism between the rotor blades 22 and the collective pitch servo 30 so as to vary the collective pitch of the rotor blades in response to the servo 30 are well known devices in the art. The present invention, however, can be utilized with any of the standard throttle or collective pitch servo-mechanisms in the art.

As an illustration of one embodiment of the invention, FIG. 2 shows a control system for operating in the governor mode, i.e., wherein the model helicopter pilot flies the helicopter 10 by variations in the collective pitch and the throttle is automatically varied so as to maintain a constant RPM of the rotor 28. It must be noted that operation in the governor mode provides an advantage in that use is made of the kinetic energy stored in the rotating blades 22, so that as collective pitch is added there is an instant response. In the governor mode illustrated in FIG. 2, as the collective pitch is being added, the applied pitch load to the helicopter is sensed and utilized to automatically vary the throttle to prevent a change in the rotational speed of the rotor 22.

As shown in FIG. 2, the signals arriving from the transmitter to the model helicopter 10, are coupled to a system receiver and decoder 34 having one output coupled on lead 36 to the collective pitch servo 30. Thus, as the model helicopter pilot varies the collective pitch control, such as control 16 in FIG. 1, the collective pitch of the rotor blades 22 is directly varied. Another output of the system receiver and decoder 34 is coupled on line 38 to a governor/pitch control device 40 constructed in accordance with the principles of the present invention. The pulses on line 38 comprise the received and decoded signals generated by an auxiliary channel control 17 on transmitter 14. A timing wheel 42 is mounted to the shaft 28 so as to rotate therewith. The wheel can be constructed of nylon and contains a series of magnetic pieces 44 mounted around the periphery thereof. In a constructed embodiment of the invention six magnetic pieces were mounted equally spaced around the perimeter of the timing wheel 42. A magnetic detector or read head 46 is mounted closely adjacent to the timing wheel 42 so as to provide an output pulse on line 48 every time a magnetic piece 44 is rotated closely adjacent the read head 46 — the time between pulses being a direct function of the shaft and main rotor RPM. The output of the governor/pitch control device 40 is coupled on line 50 to a throttle servo 52 for coupling an output throttle signal on line 54 to the engine 26.

In operation, the governor/pitch control device 40 responds to the detected RPM of the rotor blades 22 as sensed by read head 46 so as to provide a suitable control signal to the throttle servo 52 to maintain a constant RPM. In the governor mode of FIG. 2, if the model helicopter pilot, for instance, increases the collective pitch, this is coupled in a normal manner to the collective pitch servo 30 so as to vary the collective pitch of the rotor blades 22. An increase in the collective pitch places a load on the rotor shaft 28 which tends to slow down or decrease the rotational speed of the blades 22. This decrease in RPM is detected by read head 46 in that there will be a greater time separation between detected pulses on output line 48 coupled to the control device 40, such that the slower the RPM, the greater the time duration between detected pulses on line 48. Control device 40 responds to this detected tendency towards a slower RPM and provides a proportional control signal which operates on the throttle servo 52 so as to drive engine 26 to increase the rotor RPM. The system is thus constructed such that the governor/pitch control device 40 responds to variations in the pilot controlled collective pitch so as to vary the throttle and maintain a constant rotor RPM. This then allows the pilot to fly the model helicopter by controlling only the collective pitch since the throttle is automatically varied in response to changes in the collective pitch.

Figure 3:
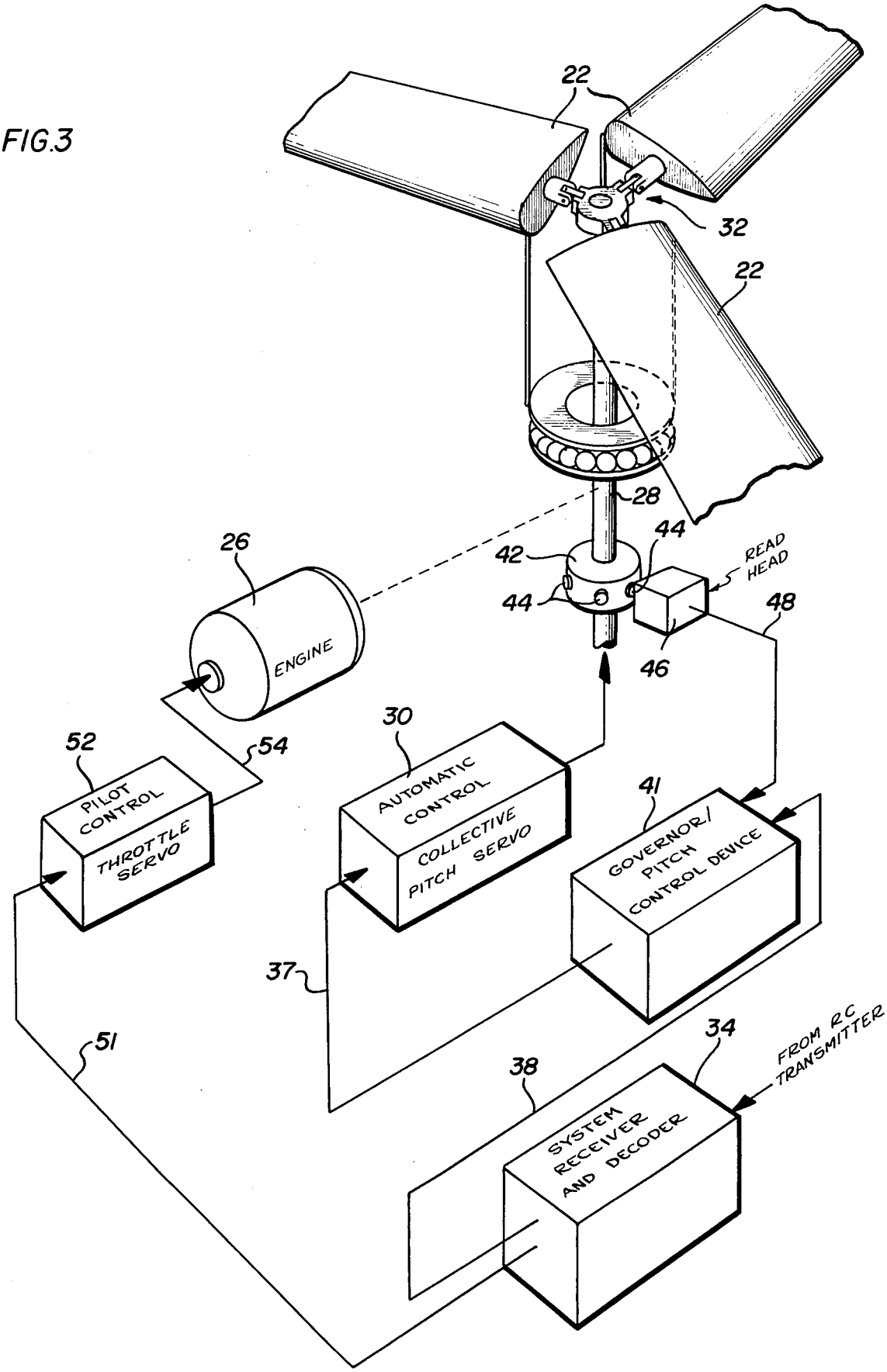
FIG. 3 illustrates another embodiment of the present invention in the auto-collective mode with the model helicopter pilot controlling the throttle and timing and control means being provided to automatically vary the collective pitch in response to the rotor RPM.

FIG. 3 illustrates another embodiment of the invention in which the system is in the auto-collective mode with the model helicopter pilot flying by controlling the throttle. As illustrated in FIG. 3, one output of the system receiver and decoder 34 is coupled on line 51 to the throttle servo 52 as in a normal situation wherein the pilot operates for instance the throttle control 16 to vary the engine 26 and thereby change the rotor RPM. The governor/pitch control device 41 is again connected to line 38 for receiving the decoded auxiliary channel pulses from transmitter 14. Control device 41 can be constructed in a manner similar to the control device 40 of FIG. 2, and any differences will be more particularly described hereinafter. The control device 41 also responds to the rotor RPM pulses on line 48 to provide an output signal on line 37 which is coupled to collective pitch servo 30 for changing the collective pitch of the rotor blades 22.

in the operation of the auto-collective mode system of FIG. 3, an increase in throttle provided by the model helicopter pilot varying the throttle stick 16 is coupled to the system receiver and decoder 34 and thence to the throttle servo 52 to tend to increase the rotor RPM. It will be noted that when flying in the governor mode, control stick 16 on transmitter 10 is a pitch control, but when flying in the auto-collective mode, stick 16 becomes a throttle control. This allows the vertical control of the model to be the same control in either mode. It must be realized that in comparison to the almost instant response in RPM in the governor mode of FIG. 2, in the auto-collective mode of FIG. 3, the response is not as fast, since the rotor RPM has to build up when the throttle is added. As the rotor RPM increases, the output pulses on line 48 are of increasingly shorter interval, and in response thereto, the control device 41 provides a proportional control signal on line 37 so as to vary the collective pitch and thereby control the collective pitch in response to RPM.

In a normal fixed pitch system in which the model helicopter is flown with the throttle control, the engine has to accelerate with a given collective pitch and therefore a particular load already applied. The load does become higher with higher RPM, since it is more difficult to turn a rotor blade at higher RPMs than at lower RPMs for a given pitch. If the engine is not producing peak power because of heating or due to an over rich fuel condition, the engine tends to bog down under the load. The auto-collective mode system of FIG. 3 improves upon these conditions. If the rotor RPM is relatively low, the collective pitch is at a slight angle and therefore the engine can accelerate at a higher rate, thereby reducing the delay time between application of the throttle and the resulting action. Also, if the engine tends to stall for some reason, the collective pitch and thereby the load on the engine is decreased, allowing the engine to again pick up in RPM. Eventually, the engine will reach a stable point in RPM under which it can carry the load for the given conditions. It is to be understood that this principle of an RPM controlled pitch system is not new since many modern day pleasure aircraft use constant RPM propellers. However, it is believed that the apparatus of the present invention enables the application of this principle for the first time to radio controlled model helicopters.

Figure 4:
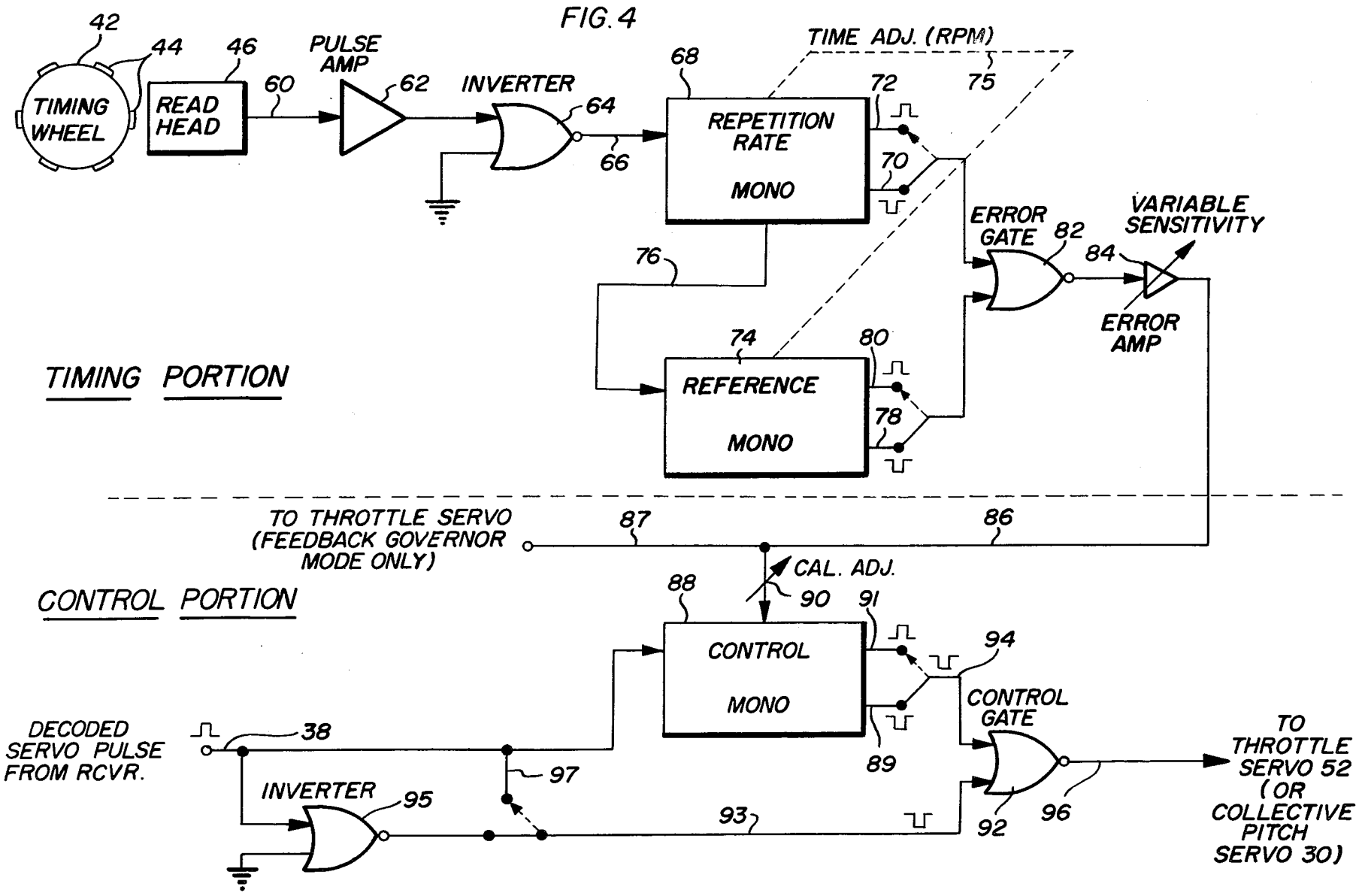
FIG. 4 is a schematic block diagram of the governor/pitch control apparatus of the present invention, portions of which may be selectively connected as shown for use in either the throttle governor mode of FIG. 2 or the auto-collective pitch mode of FIG. 3.

Referring now to FIG. 4, there is illustrated in block diagram form a constructed embodiment of the governor/pitch control device 40 of the present invention for operation in the throttle governor mode shown in FIG. 2. For convenience in describing the apparatus of FIG. 4 and the respective functions thereof, it will be assumed that such apparatus is connected for operation in the governor mode of FIG. 2. Hereinafter there will be described the manner in which essentially the same apparatus may be modified to provide a governor/pitch control device 41 to operate in the auto-collective mode of FIG. 3.

In addition it is to be understood that the following description assumes a situation wherein the throttle servo travels from one extreme to the other with a positive pulse having a pulse width going from 1 millisecond (ms) to 2ms as the transmitter control is advanced. Other systems utilize a negative pulse on the throttle servo, or vary the pulse width from 2ms to 1ms as the throttle control is advanced. The utilization of the present invention in these other situations can be readily provided by those skilled in the art, from the following description of the positive pulse, 1ms to 2ms embodiment.

As shown in FIG. 4, the timing wheel 42 includes a series of six magnetic pieces mounted around the periphery thereof so that as the timing wheel 42 is rotated along with the rotor shaft 28, each of the magnets 44 passes closely adjacent the read head 46. Read head 46 produces a pulse output every time a magnet 44 passes closely adjacent to it. In the illustration of FIG. 4, there will be six pulses produced on output line 60 during each revolution of the timing wheel 42 and the rotor blades 22. The pulses on line 60 are amplified and shaped by a pulse amplifier 62 and an inverter 64 and are coupled on line 66 to a repetition rate monostable multivibrator or rep rate mono 68. The rep rate mono 68 provides a negative output on pulse output line 70 and a positive output pulse on output line 72. A reference monostable mutlivibrator or reference mono 74 has its input coupled to the rep rate mono 68 on line 76 and provides a negative pulse on output line 78 and a positive pulse on output line 80. The corresponding negative output pulses on lines 70 and 78 are coupled respectively to the inputs of an error gate 82. If both of the outputs on lines 70 and 78 are present simultaneously at the input to the error gate, an error signal output will be produced by the error gate which is fed to a variable sensitivity error amplifier 84 for coupling through line 86 to a control monostable multivibrator or control mono 88 for developing a corresponding control signal.

The combination of the rep rate mono 68 and the reference mono 74 is used to determine whether the rotor is rotating too slow, too fast or is at the desired RPM. An incoming pulse from read head 46 triggers rep rate mono 68 ON for a time $T_1$. When rep rate mono 68 times out after $T_1$, this starts reference mono 74 ON for a time $T_2$. The duty cycles of both monos 68 and 74 are adjustable from a common duty cycle control 75 so they can track together in a manner well known in the art. The system is designed to have the rep and ref monos function at an approximate 50% duty cycle at the point where they start to limit RPM. At a rotor speed of 1000 RPM, the time interval $T_3$ between incoming detected pulses from the timing wheel 42 will be approximately 10ms, and $T_1$ and $T_2$ therefore normally will be set at 5.5ms to develop a 1ms error signal. The error signal pulse width will be slightly less than 1ms for RPMs slightly less than 1000, and slightly more than 1ms for RPMs slightly more than 1000.

Figure 5:
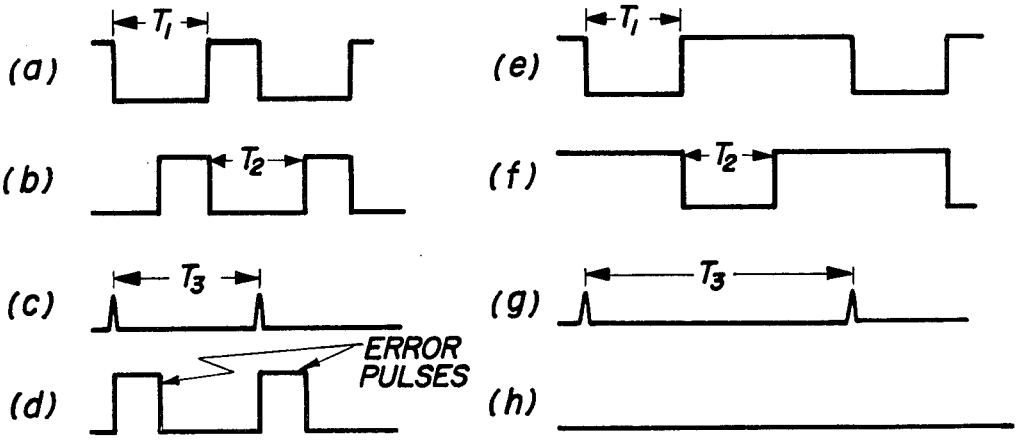
FIG. 5 is a timing diagram useful in understanding the principles of the present invention.

The development of an error signal can more readily be seen by also referring to the timing diagram of FIG. 5, wherein the output of rep rate mono 68 on line 70 is shown at 5(*a*); the output of reference mono 74 on line 78 is shown at 5(*b*); the trigger input to rep rate mono 68 on line 66 is shown at 5(*c*); and any resulting error pulse output from error gate 82 is shown at 5(*d*). With $T_1$ and $T_2$ in FIGS. 5(*a*) and (*b*) set at 5.5ms, there is illustrated a situation where the rotor RPM is much greater than 1000, so that as shown in FIG. 5(*c*), a $T_3$ of 8ms is much less than $T_1$ plus $T_2$. Under these conditions the illustrated outputs of the rep and ref monos are both ON (or negative) at the same time for a duration of 3ms until $T_2$ times out. Thus an error pulse of 3ms will appear at the output of the error gate, as shown in FIG. 5(*d*). FIGS. 5(*e*) to 5(*h*) illustrate a situation where the rotor RPM is much less than 1000. Thus $T_3$ is much longer than $T_1$ plus $T_2$, and no error signal is generated as shown in FIG. 5(*h*). This allows full throttle to be applied to quickly bring the rotor RPM back up to about 1000.

The variable sensitivity error amplifier 84 converts any error pulse at the output of error gate 82 to a given DC voltage. The DC voltage level at the output of the error amplifier 84 is proportional to the pulse width of the error pulse at the output of error gate 82. The DC error voltage on line 86 is then used to control the pulse width of the control mono 88. The control mono 88 is triggered by the decoded servo pulse from the system receiver coupled thereto via line 38, which is an auxiliary control channel pulse received from transmitter 14 and controlled by the auxiliary control 17.

In the illustrated governor mode, the line 38 is connected to the radio controlled auxiliary channel which normally provides a pulse of 1ms in width at idle and 2ms at full throttle. A calibration adjustment 90 is provided for calibrating the duty cycle and thereby the output pulse width of control mono 88 to approximately 2.2ms. In this presently described throttle governor mode, the control gate 92 is coupled to respective inputs — one from line 93 and inverter 95 which is connected to the auxiliary channel on line 38, and the other on output line 94 from negative output line 89 of the control mono. The control signal output of the control gate 92 on line 96 will be determined by the shorter or narrower input pulse to the gate arriving from either line 94 or line 93. The output of the control gate 92 is coupled on output line 96 to the throttle servo 52 via line 50.

If the rotor RPM is at a steady 1000 RPM, a 1ms error signal from error gate 82 will provide a control signal pulse width on line 96 of about 1.6–1.7ms. If the rotor RPM increases to slightly above 1000 RPM, the increased error signal pulse width will provide a decreased control signal pulse width; and if the rotor RPM decreases to slightly below 1000 RPM the decreased error signal pulse width will provide an increased control signal pulse width. It is to be understood that if the rotor RPM greatly decreases below 1000 RPM, such as in an engine stall, then no error signal is developed so that the full throttle signal of about 2ms pulse width is applied to the throttle servo to quickly increase the rotor RPM.

The calibration adjustment 90 contains a potentiometer to calibrate the governor apparatus to the individual radio control system to which it is connected. When used in the governor mode, with no engine running, the transmitter auxiliary throttle control 17 is opened full. After the throttle servo 52 has traveled to its full open position, the calibration adjust 90 is adjusted to slightly retard the servo from its full position and then turned back slightly so that there is no retarding action. In the present descriptive embodiment of the invention, for a 1ms going to 2ms pulse width system (idle to full throttle), this will set the control mono 88 output pulse width at around 2.1 to 2.2ms. If modified for a 2ms going to 1ms embodiment, the control mono pulse width will be at 0.8 to 0.9ms. The control mono 88 is now ready to have its time shortened or lengthened by the control voltage from error amplifier 84. This will depend on which embodiment is utilized, the 1 to 2ms or 2 to 1ms pulse width.

In operation in the throttle governor mode of the apparatus shown in FIG. 2, if the control mono 88 were calibrated at 2.2ms pulse width and the width of the auxiliary servo pulse on auxiliary channel line 38 was 2ms, then a 2ms pulse would be provided at the output of control gate 92 for coupling to the throttle servo 52. An increasing RPM change will be detected by the read head 46 and provide a corresponding longer pulse width error signal at the output of error gate 82 and a proportionally greater error DC voltage on line 86 which will produce a shorter or narrower control signal pulse width at the output of the control mono 88. The corresponding output pulse on line 94 will be shortened or narrowed from the static condition of 2.2ms to a new dynamic condition where it is the shorter of the two inputs into the control gate 92. The control gate 92 will therefore be controlled by the shorter or narrower pulse width on line 94 and provide an output to the throttle servo with this shorter pulse width. The shorter pulse width coupled to throttle servo 52 lowers the engine speed, lowers the rotor RPM, and thereby reduces the DC error voltage on line 86. The system will eventually reach an equilibrium at the RPM setting of the governor.

At the point of equilibrium which will be a dynamic or operational stable condition, the output of control gate 92 will have an output on line 96 of about 1.6 to 1.7 ms in length. If the model helicopter pilot now decreases the collective pitch by varying the collective pitch control 16, this will decrease the load on the engine tending to build up the rotor RPM, and thereby change the control pulse on output line 96 to a new shorter dynamic time. To insure that this equilibrium can be obtained, the error amplified 84 is provided with a variable sensitivity adjustment to prevent the system from hunting for the equilibrium level. In a constructed preferred embodiment of the invention, a feedback lead shown as line 87 is connected to the proper servo motor terminal to monitor the motor activity, thus enabling further reduction of the hunting condition, and providing higher governor sensitivity. It has been found in practice that a 50 RPM error from the normal governor setting of 1000 RPM produces a one-half throttle servo change. The rotor RPM can be held to a margin of about 30 RPM, while going from low to high collective pitch.

Thus, as can be seen, in the governor mode, at rotor RPMs slightly below the governor setting set by the RPM-time adjust control 75, a small error pulse width of less than 1ms appears at the output of the error gate 82. As the rotor RPM reaches the governor setting, an error pulse width of 1ms would appear and the error pulse width increases proportionately as the RPM exceeds the governor setting. Correspondingly, the DC error voltage on line 86 at the output of the error amplifier 84 also increases proportionately as the rotor RPM increasingly exceeds the governor setting. Also, the control pulse on output line 94 decreases proportionately in width with an increasing amount of the DC error voltage.

As previously mentioned, the same basic apparatus shown in FIG. 4 can be slightly modified to be utilized in the auto-collective mode of FIG. 3. With reference to FIG. 4, this can be done by using the illustrated positive outputs of the rep rate and ref monos on lines 72 and 80; of the control mono 88 on line 91; and of the decoded servo pulse from the receiver on line 97. These changes are illustrated by the respective solid lines to dashed lines shown in FIG. 4. As in the description of the governor mode embodiment, this also assumes a positive pulse radio control system wherein the collective pitch servo 30 is varied from minimum to maximum in response to a 1ms going to 2ms pulse width as the collective pitch control is advanced. In this case, the collective pitch servo 30 is connected to the output of the control gate 92 rather than the throttle servo as shown in FIG. 4.

In the auto-collective mode, flying the helicopter is accomplished by varying the throttle stick control. The duty cycle or RPM-time adjust control 75 is now adjusted to maximum RPM. The variable sensitivity potentiometer control in error amplifier 84 and the calibration adjustment 90 are used to adjust the maximum travel of the collective pitch servo 30. The RPM adjust 75 is then used to set the rotor RPM at which full collective pitch occurs. In the auto-collective pitch mode the error gate 82 produces an error pulse which decreases in width as rotor RPM increases and disappears when the RPM setting is attained. This is provided by connecting the error gate 82 to the complimentary side of the monostable multivibrators 68 and 74 so that the compliment is true at the output of the error gate.

When utilized as a collective pitch control system, the calibration adjust 90 always sets the 2ms point and the variable sensitivity adjust in error amplifier 84 always sets the 1ms point of the collective pitch servo — thus, these two controls adjust the travel limits of the collective pitch servo 30. When changing from a 1 to 2 ms to a 2 to 1 ms mode, the sense and calibrate adjustments will trade roles. As an example, the sense adjust always sets the 1ms end of the pulse. On a 1 to 2 ms collective system, this would be the collective pitch start setting. On a 2 to 1 collective system, this would be the full collective limit. The RPM adjust is used to set the RPM at which full collective will be attained in both modes, i.e., 1 to 2 ms and 2 to 1 ms.

To set up the auto-collective system, the helicopter would be tied down for the initial adjustments. This would allow observation of the collective pitch servo 30 while adjusting the RPM at which collective pitch started to increase. It would also allow the upper travel limit of the servo to be set. Once these extremes are set, the helicopter could then be lifted off the optimum setting of the pitch at a given RPM by means of the duty cycle or RPM adjust control 75. As an examle, the system could be set such that the collective pitch started in at 450 RPM (slightly above idle), then the throttle would slowly be opened while observing the servo for maximum travel. After this is set, the RPM control 75 could be set so that full collective pitch servo travel occurred at 1300 RPM. If while attempting to lift off, the engine RPM sounds too high, it could be brought to an idle and the RPM set lower to give more pitch at high throttle. It could again be tried for desired results to that optimum performance can be obtained and engine loading can be as desired.

Circuit devices for constructing each of the apparatus shown in FIG. 4 are well known by those skilled in the art. As an example, in a constructed embodiment of the invention, a hybrid circuit was developed using C/MOS integrated circuits and transistors.

The foregoing detailed description has been given for clearness of understanding only, and no unnecessary limitations should be understood therefrom as modifications will be obvious to those skilled in the art.

What is claimed is:

1. A throttle governor control apparatus for radio controlled model helicopters having an engine throttle servo for varying the rotational speed of the helicopter rotor and a collective pitch of said rotor, said apparatus comprising:

sensing means for periodically sensing changes in the model helicopter rotor speed in response to a first variation in collective pitch, including means for generating a timing signal corresponding to the sensed rotor speed;

reference means responsive to said timing signal for providing a reference signal representing a first sensed rotor speed;

comparison means coupled to said sensing means and said reference means for comparing said reference signal representing said first sensed rotor speed with said timing signal for a subsequently sensed rotor speed, including means for generating an error signal proportional to changes between said first and substantially sensed rotor speeds;

control signal means connected to said comparison means and responsive to said error signal for generating a control signal proportional to said error signal; and means for coupling said control signal to said throttle servo for proportionately varying said rotor speed in response to said first variation for maintaining said rotor speed substantially constant in response to variations in collective pitch.

2. An auto-collective pitch control apparatus for radio controlled model helicopters having an engine throttle servo for varying the rotational speed of the helicopter rotor and a collective pitch servo for varying the collective pitch of said rotor, said apparatus comprising:

sensing means for periodically sensing changes in the model helicopter rotor speed in response to a first variation in rotor speed, including means for generating a timing signal corresponding to the sensed rotor speed;

reference means responsive to said timing signal for providing a reference signal representing a first sensed rotor speed;

comparison means coupled to said sensing means and said reference means for comparing said reference signal representing said first sensed rotor speed with said timing signal for a subsequently sensed rotor speed, including means for generating an error signal proportional to changes between said first and subsequently sensed rotor speeds;

control signal means connected to said comparison means and responsive to said error signal for generating a control signal proportional to said error signal; and means for coupling said control signal to said collective pitch servo for proportionately varying said collective pitch in response to said first variation in rotor speed.

3. Control apparatus for radio controlled model helicopters having an engine throttle servo for varying the rotational speed of the helicopter rotor and a collective pitch servo for varying the collective pitch of said rotor, said apparatus comprising:

sensing means for periodically sensing changes in the model helicopter rotor speed in response to a first variation in rotor speed or collective pitch, including means for generating a timing signal corresponding to the sensed rotor speed;

said sensing means including, a series of magnetic members mounted equidistantly around said model helicopter rotor for rotation therewith;

a magnetic transducer element rigidly mounted in position immediately adjacent said series of magnetic members for detecting the movement of each of said members adjacent said transducer element during rotation of said rotor; and a first monostable multivibrator coupled to said magnetic transducer element, said first monostable multivibrator triggered ON by the detected movement of said members;

reference means responsive to said timing signal for providing a reference signal representing a first sensed rotor speed;

comparison means coupled to said sensing means and said reference means for comparing said reference signal representing said first sensed rotor speed with said timing signal for a subsequently sensed rotor speed, including means for generating an error signal proportional to changes between said first and subsequently sensed rotor speeds;

control signal means connected to said comparison means and responsive to said error signal for generating a control signal proportional to said error signal; and means for coupling said control signal to a respective one of said servos for proportionately varying either said rotor speed for said collective pitch in response to said first variation.

4. Control apparatus as claimed in claim 3, wherein said reference means comprises:

a second monostable multivibrator coupled to said first monostable multivibrator for being triggered ON by the return OFF of said first monostable multivibrator; and further including, adjusting means coupled to said first and second monostable multivibrators for simultaneously varying their duty cycles.

5. Control apparatus as claimed in claim 4, wherein said comparison means comprises:

an error gate having respective inputs coupled to the outputs of said first and second monostable multivibrators, and including means for generating said error signal in response to both of said monostable multivibrators being ON.

6. Control apparatus as claimed in claim 5, wherein said control signal means comprises:

a third monostable multivibrator;

means for periodically triggering ON said third monostable multivibrator;

means for coupling said error signal to said third monostable multivibrator for varying the duty cycle thereof in response to said error signal; and a control gate coupled to said third monostable multivibrator, including means for providing said control signal in response to variations in the duty cycle of said third monostable multivibrator.

7. In radio controlled model helicopter apparatus including a model helicopter, a helicopter rotor, an engine for rotating said rotor, a throttle servo connected to said engine for varying the model helicopter rotor speed function, a collective pitch servo coupled to said rotor for varying the rotor collective pitch function, and a radio receiver for receiving a radio transmitter signal for manually controlling one of said helicopter functions from said radio transmitter, the improvement comprising:

sensing means for periodically sensing changes in the model helicopter rotor speed in response to a manual variation in one of said helicopter functions, including means for generating a timing signal corresponding to the sensed rotor speed;

reference means responsive to said timing signal for providing a reference signal representing a first sensed rotor speed;

comparison means coupled to said sensing means and said reference means for comparing said reference signal representing said first sensed rotor speed with said timing signal for subsequently sensed rotor speed, including means for generating an error signal proportional to changes between said first and subsequently sensed rotor speeds;

control signal means connected to said comparison means and responsive to said error signal for generating a control signal proportional to said error signal; and means for coupling said control signal to the other of said servos for varying the respective other of said helicopter functions in response to said manual variation of said first helicopter function, including means for coupling said control signal to said throttle servo for maintaining said rotor speed substantially constant in response to manual variations in collective pitch.

8. In radio controlled model helicopter apparatus including a model helicopter, a helicopter rotor, an engine for rotating said rotor, a throttle servo connected to said engine for varying the model helicopter rotor speed function, a collective pitch servo coupled to said rotor for varying the rotor collective pitch function, and a radio receiver for receiving a radio transmitter signal for manually controlling one of said helicopter functions from said radio transmitter, the improvement comprising:

sensing means for periodically sensing changes in the model helicopter rotor speed in response to a manual variation in one of said helicopter functions, including means for generating a timing signal corresponding to the sensed rotor speed;

reference means responsive to said timing signal for providing a reference signal representing a first sensed rotor speed;

comparison means coupled to said sensing means and said reference means for comparing said reference signal representing said first sensed rotor speed with said timing signal for subsequently sensed rotor speed, including means for generating an error signal proportional to changes between said first and subsequently sensed rotor speeds;

control signal means connected to said comparison means and responsive to said error signal for generating a control signal proportional to said error signal; and means for coupling said control signal to the other of said servos for varying the respective other of said helicopter functions in responsive to said manual variation of said first helicopter function including means for coupling said control signal to said collective pitch servo for proportionally varying said collective pitch in response to manual variations in rotor speed.

* * * * *

UNITED STATES PATENT OFFICE

CERTIFICATE OF CORRECTION

Patent No. 4,071,811 Dated January 31, 1978

Inventor(s) Arlyle F. Irwin

It is certified that error appears in the above-identified patent and that said Letters Patent are hereby corrected as shown below:

| | | |
|---|---|---|
| Column 2, | line 43, | change "autocollective" to --auto-collective--. |
| Column 4, | line 58, | change "in" to --In--. |
| Column 6, | line 53, | after "in FIG. 5(d)." insert new paragraph starting with --FIGS. 5(e) to 5(h)--. |
| Column 9, | line 28, | change "off the" to --off for--. |
| Column 9, | line 30, | change "examle" to --example--. |
| Column 9, | line 40, | change "to that" to --so that--. |
| Column 10, | line 3, | change "substantially" to --subsequently--. |

Signed and Sealed this

Thirtieth Day of May 1978

[SEAL]

Attest:

RUTH C. MASON
Attesting Officer

LUTRELLE F. PARKER
Acting Commissioner of Patents and Trademarks